US005163967A

United States Patent [19]

Hoffman et al.

[11] Patent Number: 5,163,967

[45] Date of Patent: Nov. 17, 1992

[54] DECK CONSTRUCTION

[76] Inventors: Paul Hoffman; Sam H. Bright, both of P.O. Box 2628, Eugene, Oreg. 97402

[21] Appl. No.: 763,870

[22] Filed: Sep. 19, 1991

Related U.S. Application Data

[63] Continuation of Ser. No. 507,002, Apr. 10, 1990, abandoned, which is a continuation of Ser. No. 319,852, Mar. 3, 1989, which is a continuation of Ser. No. 101,832, Sep. 28, 1987, which is a continuation-in-part of Ser. No. 926,291, Nov. 3, 1986, Pat. No. 4,724,642.

[51] Int. Cl.[5] ..... E02D 27/00

[52] U.S. Cl. ..... 52/299; 52/169.9; 52/294; 52/297; 52/298

[58] Field of Search ..... 52/294, 298, 299, 296, 52/297, 292, 169.9

[56] References Cited

U.S. PATENT DOCUMENTS

| | | | |
|---|---|---|---|
| 357,217 | 2/1887 | McCallip . | |
| 364,427 | 6/1887 | McCallip . | |
| 469,638 | 2/1892 | Chase . | |
| 1,162,164 | 11/1915 | Honens . | |
| 2,129,211 | 9/1938 | Hickl . | |
| 3,505,764 | 4/1970 | Cagigal Gutierrez . | |
| 3,706,168 | 12/1972 | Pilish | 52/294 |
| 4,614,070 | 9/1986 | Idland . | |
| 4,724,642 | 2/1988 | Hoffman et al. . | |

FOREIGN PATENT DOCUMENTS

| | | | |
|---|---|---|---|
| 28094 | 2/1931 | Australia | 52/294 |
| 881835 | 9/1971 | Canada . | |
| 39614 | 11/1981 | European Pat. Off. | 52/299 |
| 3014523 | 3/1968 | Fed. Rep. of Germany . | |
| 2902322 | 7/1980 | Fed. Rep. of Germany . | |
| 946337 | 12/1948 | France . | |
| 1413829 | 8/1965 | France | 52/299 |
| 1528620 | 6/1968 | France | 52/294 |
| 55-729 | 4/1980 | Japan | 52/294 |
| 777185 | 9/1980 | U.S.S.R. | 52/299 |
| 705086 | 2/1992 | U.S.S.R. . | |
| 822738 | 8/1956 | United Kingdom . | |

*Primary Examiner*—Michael Safavi
*Attorney, Agent, or Firm*—Eugene M. Eckelman

[57] ABSTRACT

A deck construction includes a concrete pier block having an upwardly opening recess forming an anchor seat for building elements. The recess opens out the side so that building elements can be laid horizontally therein. The recess also includes a central socket for receiving an upright pillar. The recess has particular dimensions for use with conventional existing lumber sizes and also for forming a strong but inexpensive concrete pier block for residential use.

3 Claims, 9 Drawing Sheets

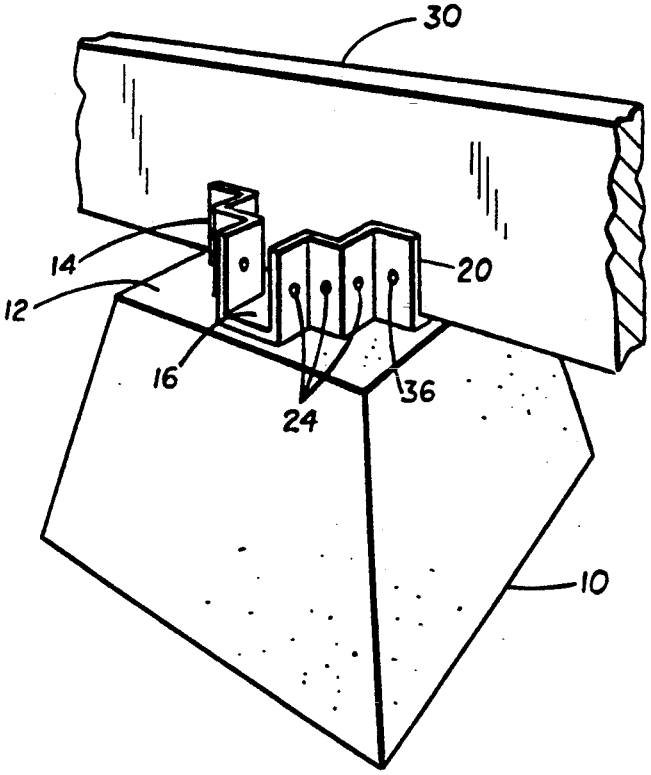
FIG. 5
FIG. 6
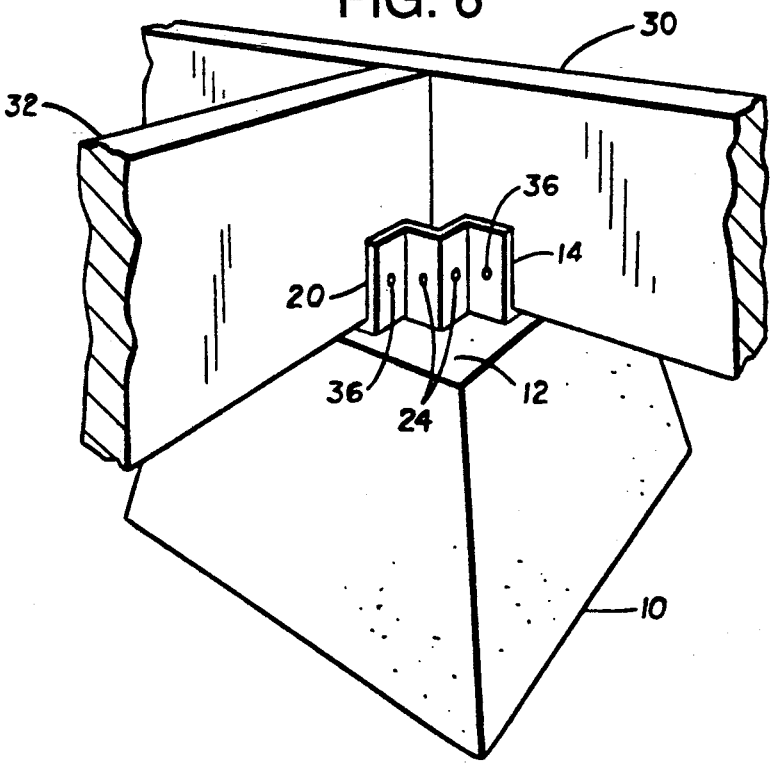

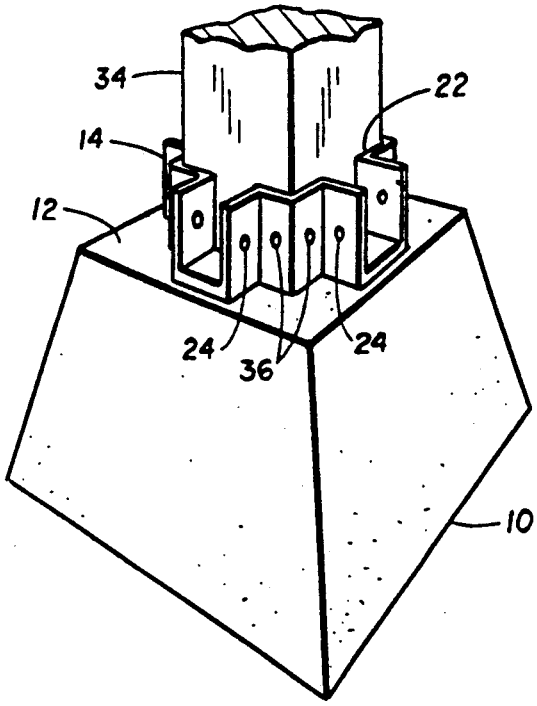
FIG. 7
FIG. 8
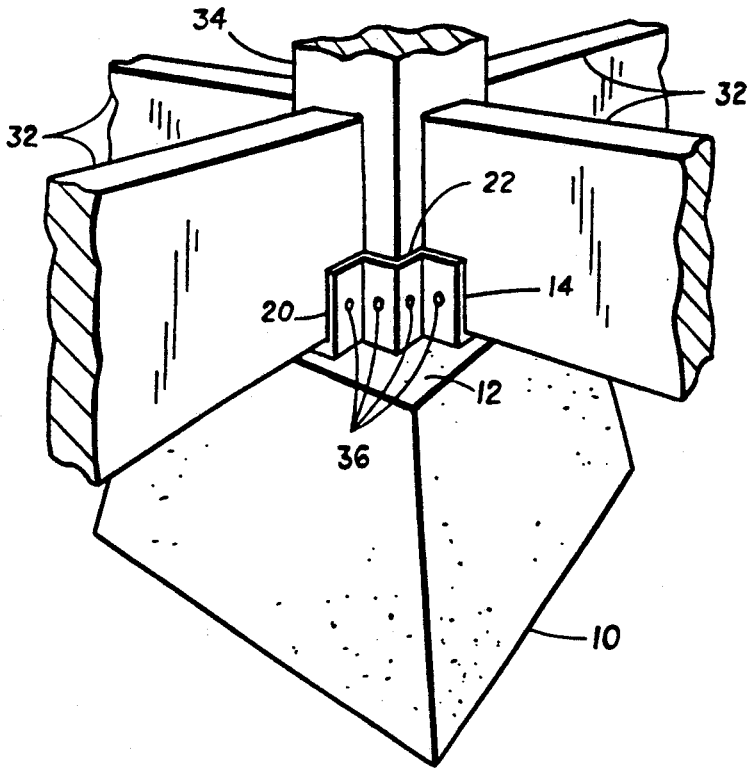

DECK CONSTRUCTION

REFERENCE TO THE PRIOR APPLICATIONS

This application is a continuation of application Ser. No. 507,002, filed Apr. 10, 1990, now abandoned, which is a continuation of application Ser. No. 07/319,852 filed Mar. 3, 1989, which is a continuation of application Ser. No. 07/101,832, filed Sep. 28, 1987, which is a continuation-in-part of application Ser. No. 06/926,291 filed Nov. 3, 1986, now U.S. Pat. No. 4,724,642.

BACKGROUND OF THE INVENTION

This invention relates to a new and unique improvement in outdoor residential constructions and is particularly concerned with deck constructions on unprepared and unleveled building sites utilizing an improved single cast, one-piece supporting pier block having all the required support and connecting means without additional components.

Various types of devices have heretofore been used for supporting and/or connecting building elements, such as horizontal beams, joists, stringers, posts and pillars, to a base slab, footing, foundation or block member. For example, such devices comprise anchor studs, metal brackets, or other supports or devices which are permanently embedded in the concrete in the manufacturing process of the blocks and which are required to make them functional. Such devices or additional components are used to provide vertical and lateral mechanical connection of building elements to a base or as components to other elements but do not have an individual identity or non-mechanical application which facilitates the inexpensive and convenient construction of a simple deck, such as a deck that may be built by the average home owner on unprepared and unleveled ground typical to the backyard of a suburban residence.

SUMMARY OF THE INVENTION

According to the present invention and forming a primary objective thereof, a deck construction is provided which by its combination with a novel pier block amounts to an improvement over prior structures.

Another object of the invention is to provide a pier block of the type described capable of directly receiving deck support members without mechanical connections or additional components, all in a variety of selected support configurations for decks being constructed on unprepared and unleveled building sites not heretofore available.

In carrying out the objectives, the invention utilizes a single cast, one-piece pier block which comprises a body member serving as a capable support on unprepared and unleveled building sites, those uneven ground areas having localized dips, slopes and random level areas therein. The body member has a single recess means molded into the top surface which is capable of receiving a horizontal deck surface support member and is also capable of receiving a vertical wood post or pillar. The recess means can have particular dimensions for using conventional, existing lumber sizes and also such dimensions are such that the required integral strength of the block is maintained due to the manufacturing process and application without the necessity of using reinforcing bar steel or additional integral components. All of these features combine in a structural arrangement which automates and standardizes the manufacture and facilitates marketing, at a lower unit and re-sale cost a deck that can be preplanned and pre-cut. Such deck is simplified and inexpensive and capable of construction by the average do-it-your-self home owner desiring a deck on the unprepared and unleveled ground of a backyard to a suburban residence.

The invention will be better understood and additional objects and advantages will become apparent from the following description taken in connection with the accompanying drawings.

BRIEF DESCRIPTION OF THE DRAWINGS

FIGS. 5, 6, 7 and 8 are perspective views showing various applications of the embodiment of FIG. 1 for association with structural building elements;

DETAILED DESCRIPTION OF PREFERRED EMBODIMENTS

Figure 1:
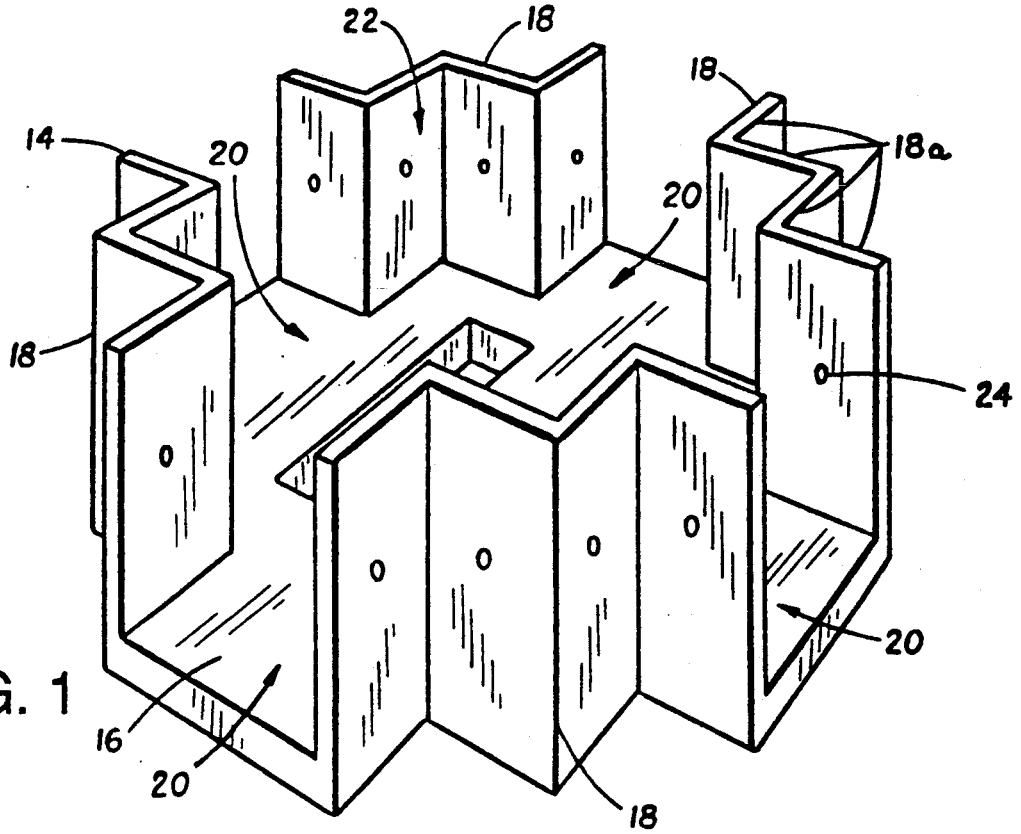
FIG. 1 is a top perspective view of a construction device embodying features of a first embodiment of the invention.

With reference first to FIGS. 5 through 8, the numeral 10 represents a base or pier block of conventional structure which is commonly used to support decks, carports, etc. This block is generally constructed of concrete and assumes different shapes. In most cases, the block is tapered to a lesser dimension toward the top. The top and bottom surfaces 12 are flat.

According to the present invention, a first embodiment of the invention comprises a construction device 14, FIGS. 1–8, which may be molded, stamped, or otherwise formed from a tough plastic or metal. The body member of the device 14 includes a flat bottom wall 16 and four identically shaped or symmetrical upright quarter sections 18. Each of the sections 18 comprises four zig zag panels **18*a* joined integrally at right angles. These symmetrical quarter sections are shaped to form a recess or opening 20 on each side, with oppositely located recesses being laterally aligned. Also, with this quarter section construction, a square central socket 22 is formed. Laterally aligned recesses 20** provide a full width slot open at the sides.

Figure 2:
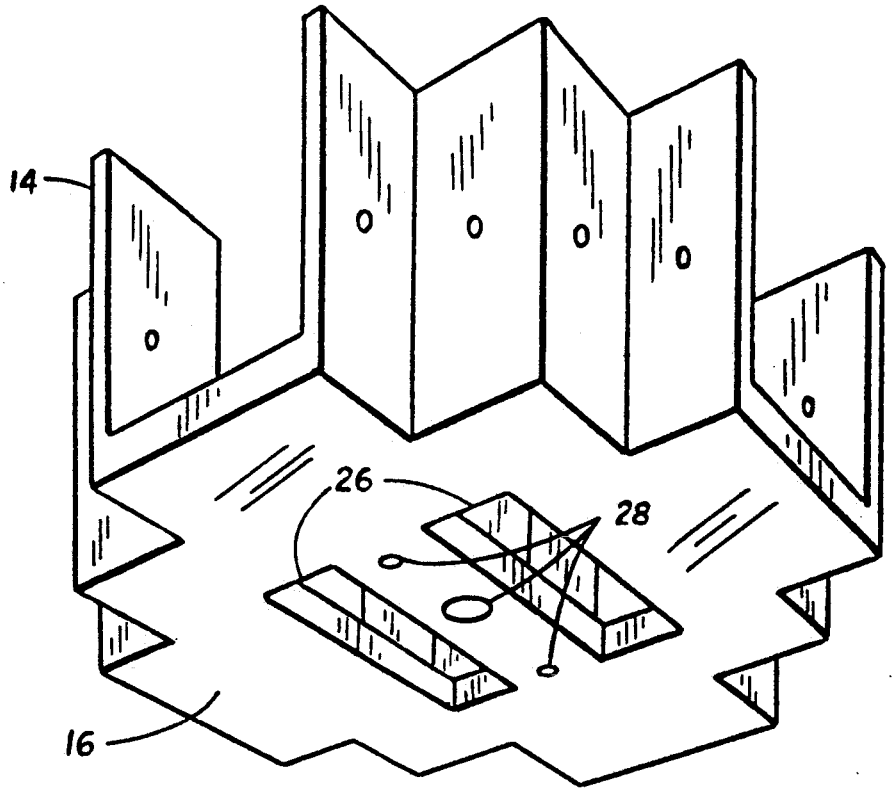
FIG. 2 is a bottom perspective view of the embodiment of FIG. 1.

Each of the panel sections **18*a* has one or more apertures 24 therein provided to receive fasteners, to be seen hereinafter, for securement of building elements to the device 14. As seen in FIG. 2, cutouts 26 are provided in the bottom wall 16 for reducing the weight of the member as well as for conserving material. Also, apertures 28 are provided in the wall 16 for secured attachment of the member 14 to a base, such as to a block 10**, concrete slab, or other support means.

FIGS. 5, 6, 7 and 8 show various applications of the construction device 14 with building element such as support members and pillars. FIG. 5 for example shows a horizontal decking surface support member 30 seated edgewise on the bottom wall 16 and extending fully through the device and out both side recesses 20. FIG. 6 shows a support member 30 similarly supported as in FIG. 5 but also showing a right angle support member 32 extending through a 90 degree side recess 20 and abutted against the support member 30. FIG. 7 shows a vertical pillar 34 supported on the device 14 and fitted in the central socket 22. FIG. 8 shows a pillar 34 similarly fitted in the socket 22 as in FIG. 7 but also showing side beams 32 extending in from all four of the side recesses. These members may simply be fitted in the respective recesses 20 or socket 22 but in most cases secured attachment to the member 14 is accomplished by fasteners 36 extending through the apertures 24. Also, device 14 can first be secured to the base member by fasteners extending through the apertures 28.

Figure 3:
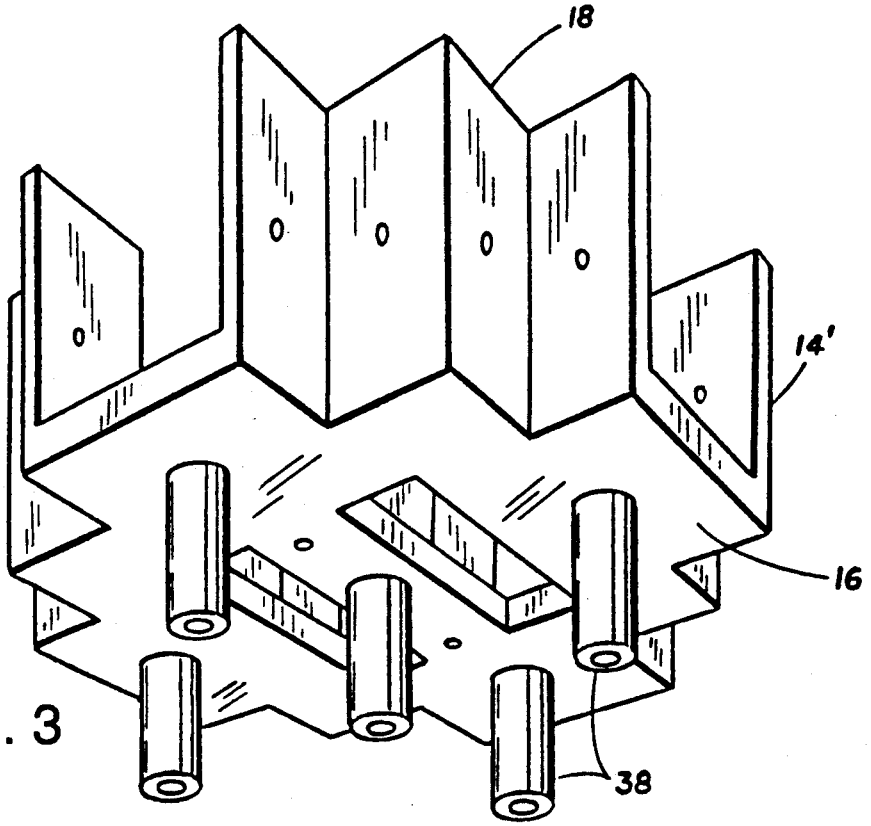
FIGS. 3 and 4 are bottom perspective views of embodiments having support and securing means for the body member relative to a base.
Figure 4:
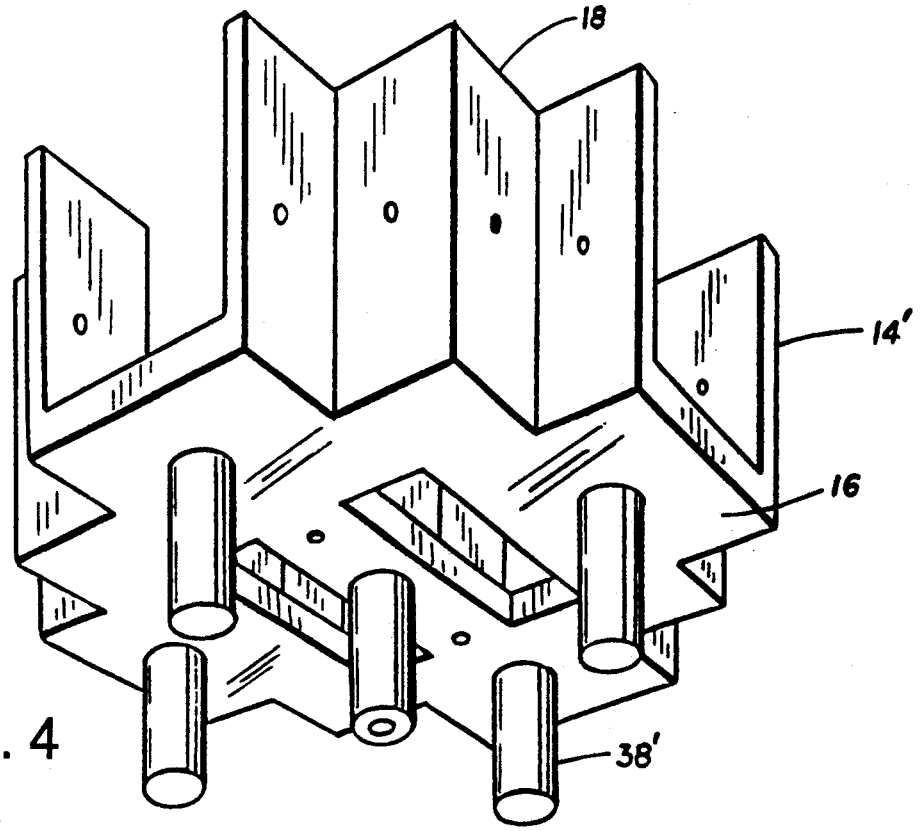

FIG. 3 is a bottom perspective view of a construction device 14' having a bottom wall 16 and side walls 18 in an arrangement similar to that shown in FIGS. 1 and 2. This structure, however, is formed, such as by integral molding, with a plurality of depending foot members 38. Four of such foot members are shown, as well as a central foot member, but any number of such foot members may be provided. In the FIG. 3 embodiment, the foot members 38 are hollow whereby long fasteners can be inserted down from the top through the wall 16 and into a base for secured attachment of the construction device 14' to the base. FIG. 4 shows a structure similar to FIG. 3 except that the outer foot members 38' are solid and not hollow. This embodiment may be employed in circumstances where it is not necessary to use vertical fasteners around an outer portion of the member.

FIGS. 9–12 illustrate an embodiment of the invention employing means for anchoring the body member against lateral shifting. In this embodiment, the body member 14'' is the same as that shown in FIG. 1 as to quarter panel sections **18*a* and their formation of aligned recesses 20 and central socket 22. To accomplish the lateral anchoring feature the outermost panel section 18*a* of each quarter section has a depending projection or lip 40 defined by a bottom wall portion 42 integral with side extensions 44 and a rear wall portion 46. Rear wall portion 46 preferably angles outwardly toward the bottom whereby to coincide with the angle of the side surfaces of a pier block 10 of the type shown in FIGS. 5–8. Wall portion 46** can extend at the desired angle, so as to have flush engagement with the pier block sides.

Figure 9:
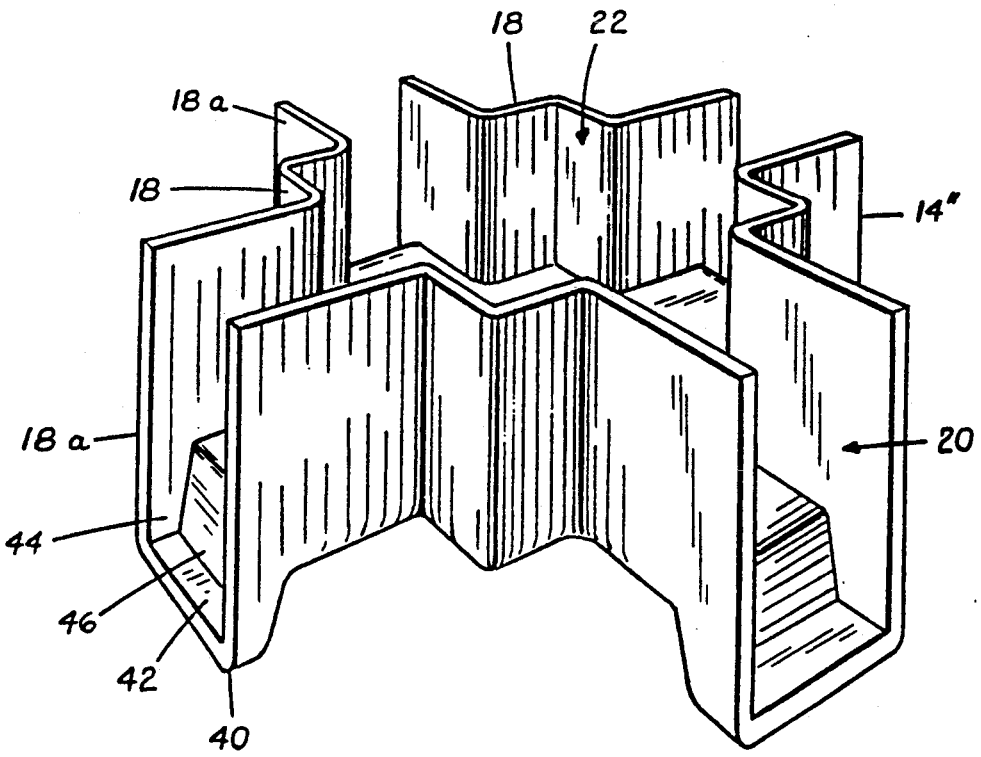
FIG. 9 is a top perspective view of another embodiment of the invention, this embodiment including lateral stabilizing means on the body member.
Figure 10:
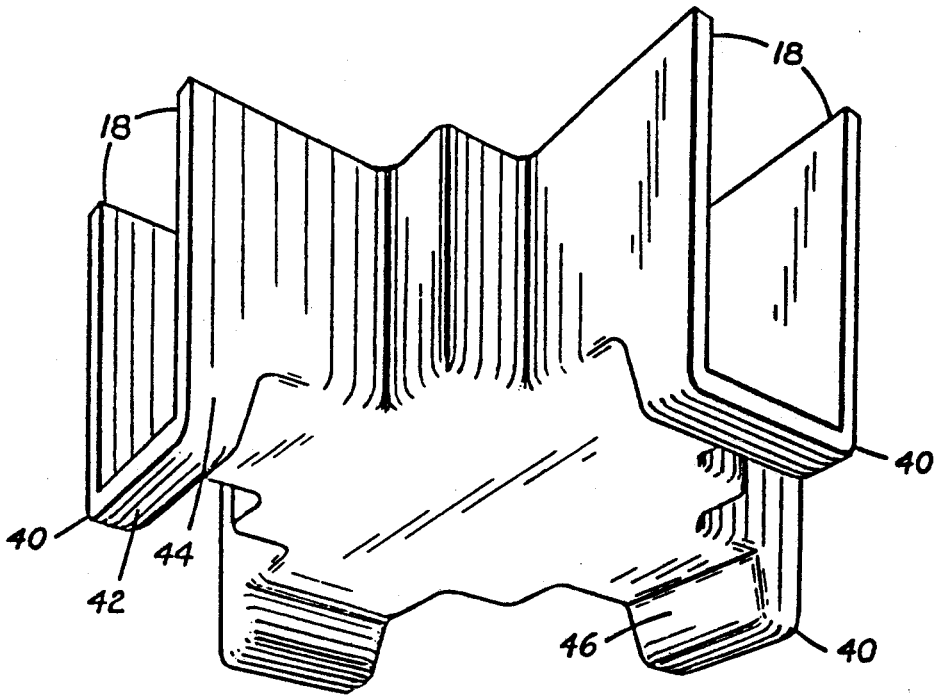
FIG. 10 is a bottom perspective view of the embodiment of FIG. 9.
Figure 11:
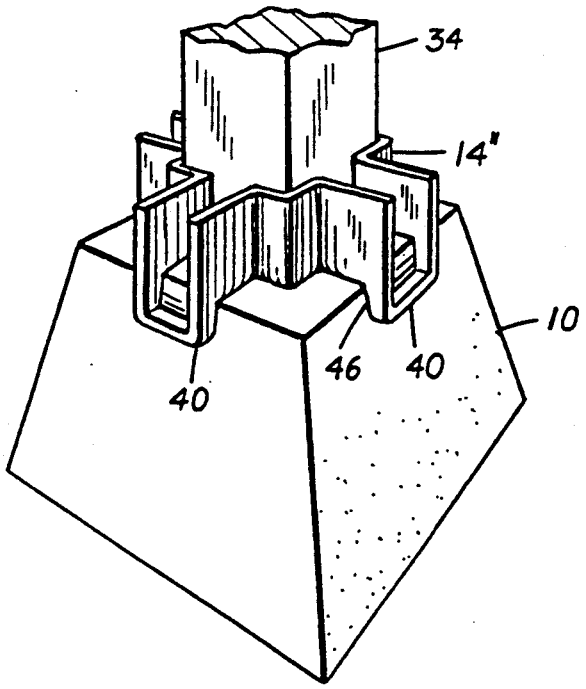
FIGS. 11 and 12 are perspective views showing various applications of the embodiment of FIG. 9.
Figure 12:
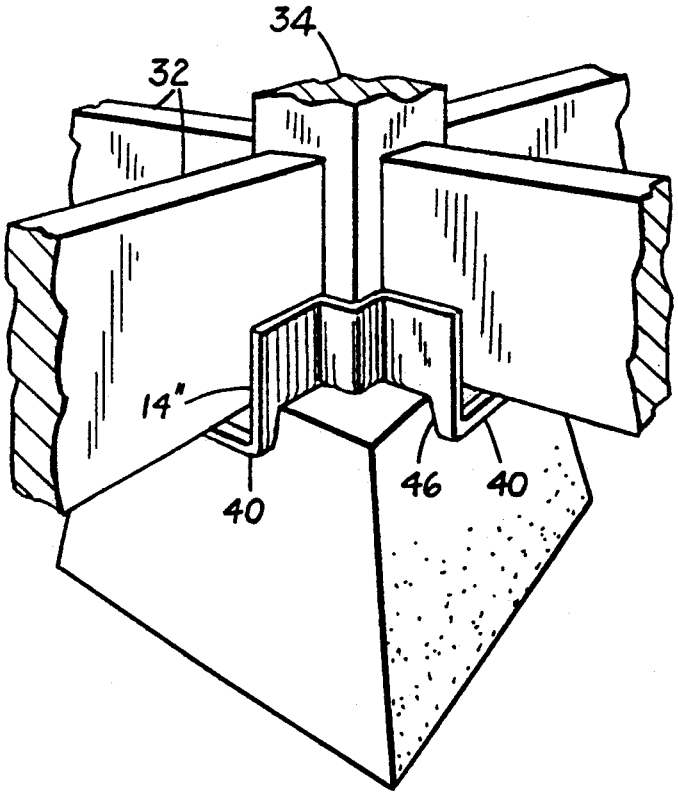

FIGS. 11 and 12 show application of the device 14'' of FIG. 9 to a pier block. In such arrangement, the device and the building elements therein are anchored or locked against lateral shifting. Fasteners extending through the bottom wall of the device are not necessary, although such fasteners can be used if desired. The cross dimension of the device between wall portions 14'' can be preselected according to the size of the pier block so that a snug or frictional fit is provided.

Figure 13:
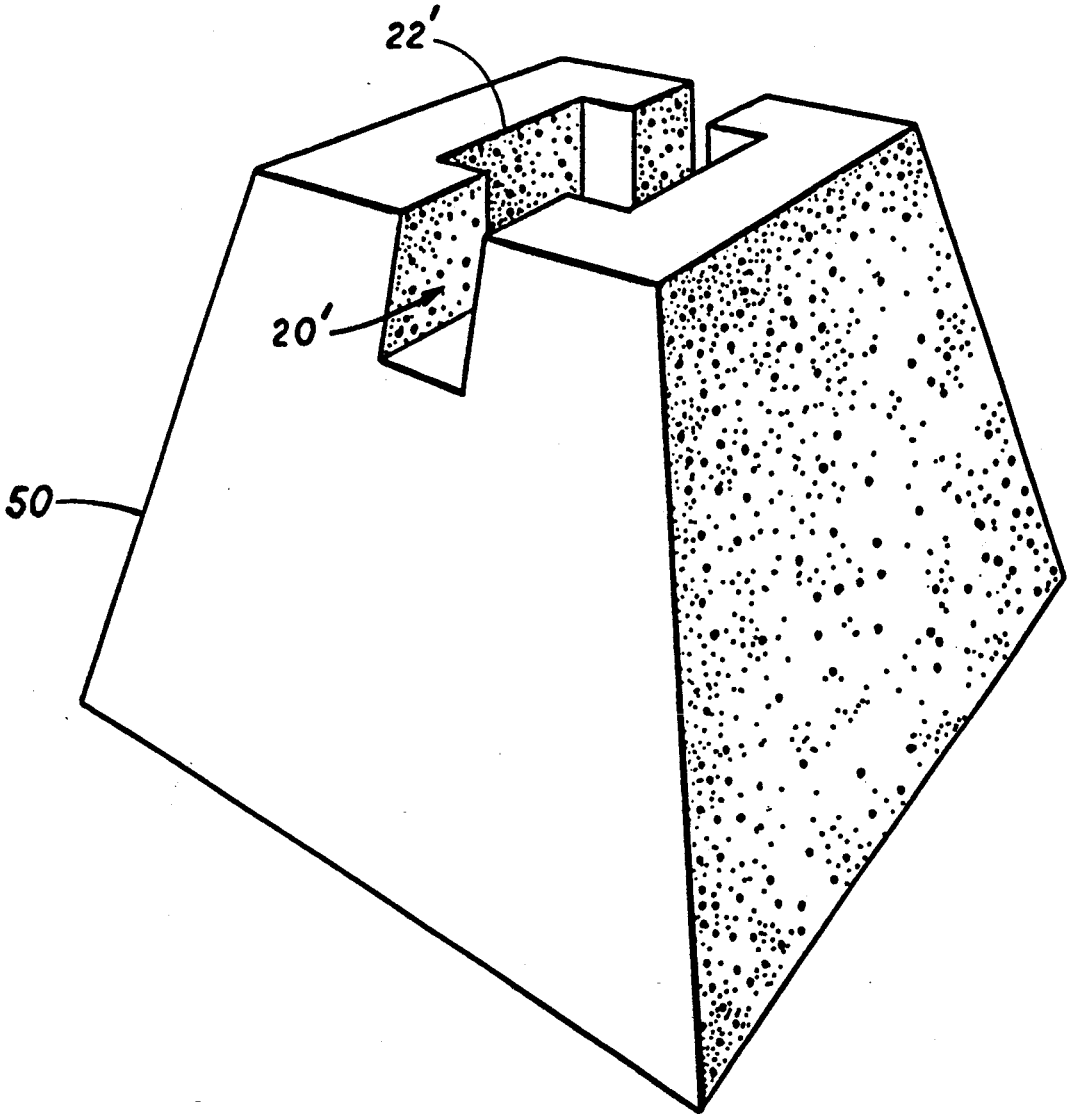
FIG. 13 is a perspective view of a pier block forming a part of the invention.
Figure 14:
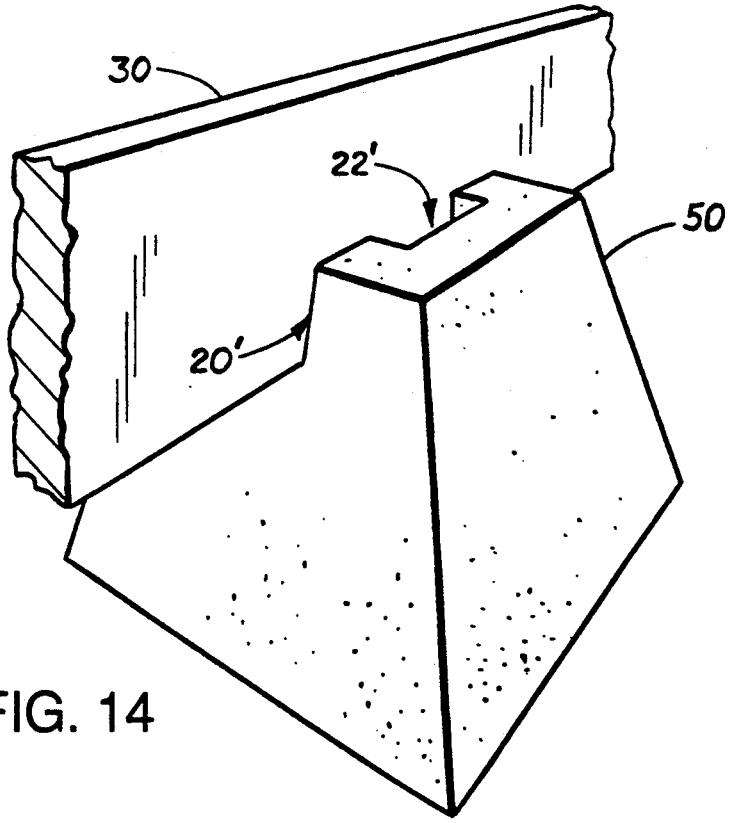
FIGS. 14 and 15 show applications of this latter embodiment with deck constructions.
Figure 15:
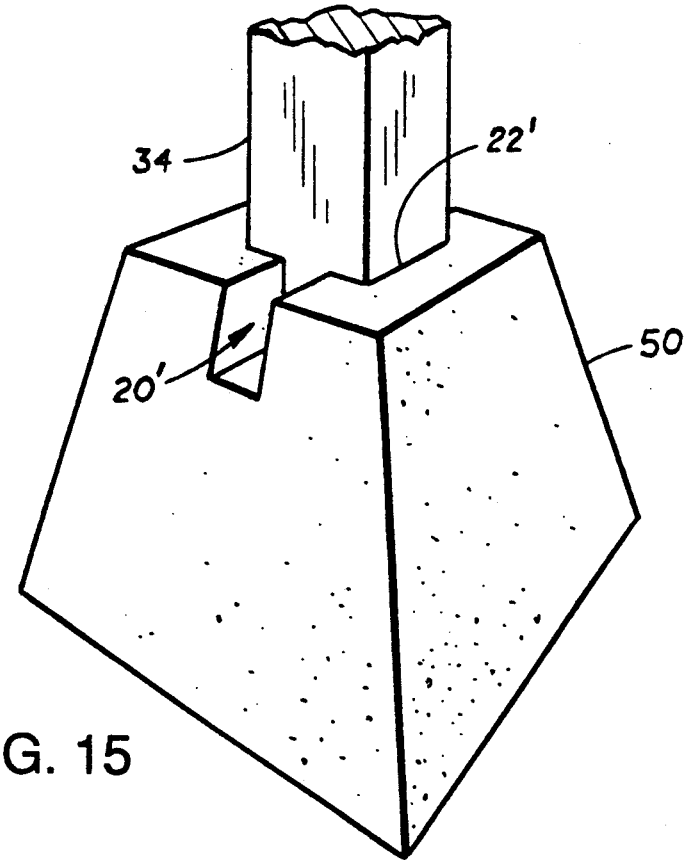
Figure 17:
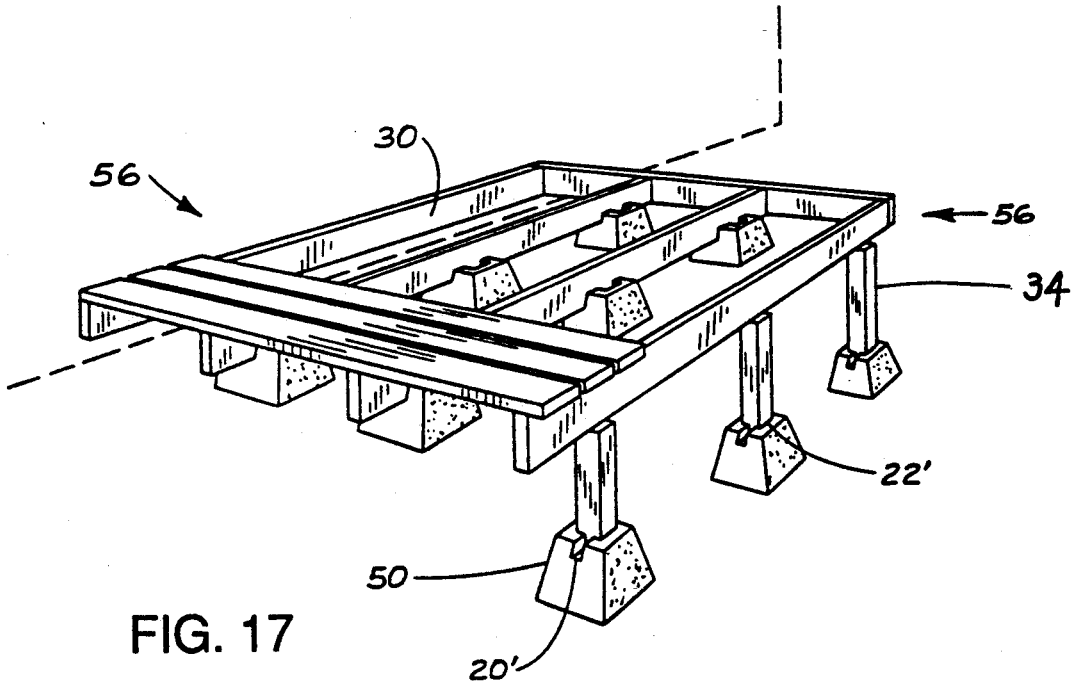
FIG. 17 is a perspective view of another form of deck using concepts and structure of the pier block of FIG. 13.

With reference to FIGS. 13, 14 and 15, the concept of the invention utilizes the single pier block 50 as the base or ground support for a deck construction wherein both horizontal and vertical support members provide for a level deck surface on a building site of uneven ground. This is accomplished by the recess of block 50 having a central socket portion 22' and two equal narrower portions 20' which extend inward from the outer edges of two opposite sides of the top surface of the block 50 and lead into the central socket portion as best shown in FIG. 13. The two narrower portions 20' are for receiving a horizontal decking surface support member 30 which also passes through the central socket portion 22', as shown in FIG. 14. The central socket portion 22' is for receiving a vertical pillar support 34, independent of the two equal narrower portions 20' as shown by FIG. 15. The horizontal decking surface support member 30 and the vertical pillar support member 34 being mutually exclusive to each other in the single block 50 and also mutually interchangeable with each other in the same block 50. This is applied to concrete pier blocks designed for constructing a deck on an unprepared and unleveled building site, an example of which is shown by FIG. 17. Such decks on uneven ground, using the present block, are extremly simplified in their construction and can be supplied in preplanned, pre-cut units. Other advantages also exist in the structure, as will be apparent hereinafter.

Figure 16:
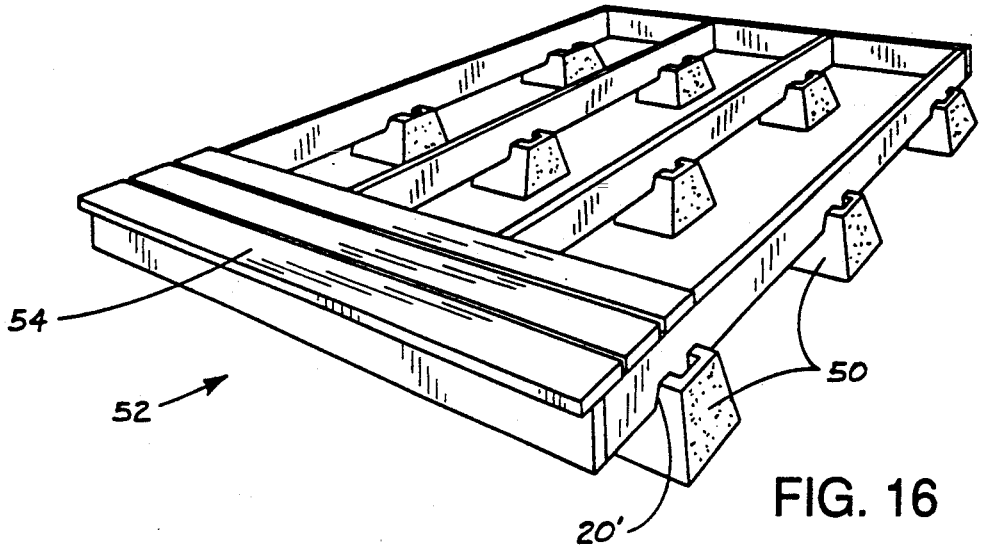
FIG. 16 is a perspective view of one form of deck using the pier block of FIG. 13.

The deck shown in FIG. 16, designated by the numeral 52, comprises the pier blocks 50 as the base or ground support for the deck, each of the blocks 50 receiving such lumber as a 2 inch thick (1½ inch thick nominal) horizontal decking surface support member 30 in the two narrower portions 20' and central socket portion 22' of block 50, each member 30 in block 50 then supporting the deck surface material 54 which is nailed in place and each block 50 supporting the horizontal decking surface support member and decking surface material 54, those blocks 50 being on bare or unprepared ground of a building site. The deck shown in FIG. 17, designated by the numeral 56, similarly uses some pier blocks 50 as supporting the horizontal decking surface support 30 and decking surface material 54 and also illustrates the use of some blocks 50 as the base or ground support for directly receiving vertical piller 34 set in the central socket 22' when member 30 is not in block 50, member 34 then providing support to member 30 by member 30 being on top of member 34 and those blocks 50 then supporting the vertical pillar support 34 and the horizontal decking surface support member 30 and the decking surface material 54, due to localized variations of the ground within an unprepared and unleveled building site. A deck support member 30 can also be fastened to a building.

The particular structure of the manufactured pier block makes it possible to construct an extremely simplified deck and one which can be pre-planned and pre-cut if desired. That is, such lumber as 2 inch thick deck support members 30 and vertical wood pillars 34 which can be used therewith comprise conventional existing material, namely, the 2 inch thick deck support members 30 can comprise 2×6's or 2×4's and pillars 34 can comprise 4×4's. The two equal narrower portions can be 2 inches deep and have a width of 1¾ inches. This latter dimension would receive conventional finished 2×6's (1½ inches thick) and 2×4's (also 1½ inches thick). 2×6's and 2×4's have finished height dimensions of 5½ and 3½ inches, respectively, whereby the deck support members, whether 2×6's or 2×4's, project to a minimum necessary height above the top surface of the blocks 50 when seated in the recess for supporting the decking thereon. The central socket portion 22' can be 2 inches deep, similar to the narrower portions 20'. Such socket portion is square, having and can have dimensions of $3\frac{3}{4}$ inches for receiving a conventional finished $4\times4$ ($3\frac{1}{2}$ inches square) lumber support pillar. The vertical pillar becomes sufficiently fixed in socket portion 22, in the block for deck construction purposes, as does the horizontal deck support member in the two narrower portions 20', also being within the central socket portion 22' when the member 34 is not in the block 50, for lateral stability.

Pier block 50 is designed to provide support to a deck unleveled on or unprepared building sites with no additional components required. For this purpose, the block is molded into a unitary four sided equal pyramidal body with a truncated apex. It is tapered to a larger dimension toward a flat bottom. The top and bottom surfaces are flat and square. The enlarged bottom surface combined with the mass of the block below the formed recess; allows the block to serve as its own footing. The design of the concrete block 50 maintains the necessary integral strength, to the deck, without the necessity of re-bar reinforcement and thus contributes to manufacture of a pier block and deck structure in a pre-planned and pre-cut unit which is also sufficiently simplified in its use, standardized in its manufacture, and sufficiently inexpensive for deck construction by the average do-it yourself homeowner, on unprepared and unleveled ground areas such as are typical to the backyard of a suburban residence. Since the recess can be two inches deep, that further provides for the block being integrally sufficient to support the deck height from 8 inches to one foot.

The recess of the pier block of FIG. 13 automatically and non-mechanically centers the horizontal decking surface support member 30 in the block 50 when the vertical pillar 34 is not in the block, as shown in FIG. 14, and also does the same for the vertical pillar member 34 when the horizontal member 30 is not in the block, as shown in FIG. 15, which automates the connection and securement of these support members to the pier block for a deck construction as shown in FIG. 17. Mounted engagement of the horizontal surface support member and vertical pillar with the block is accomplished in a connector-free relationship, namely, without metal brackets, embedded connectors, etc., thus allowing individual blocks of a deck construction on the uneven ground of an unleveled and unprepared building site to be adjusted without the need of any disassembly of the deck (i.e. removing bolts, nails or screws). Also the recess of the pier block 50 maintains horizontal and vertical members in parallel which is critical in construction of the deck.

It is to be understood that the forms of our invention herein shown and described are to be taken as preferred examples of the same and that other changes in the shape, size and arrangement of parts may be resorted to without departing from the spirit of our invention or the scope of the following claims.

Having thus described our invention, we claim:

1. A deck construction for uneven ground comprising:

decking surface material, selected deck support members and a plurality of manufactured concrete pier blocks, said selected deck support members having a configured arrangement that includes lumber horizontal decking surface support members and lumber vertical pillar supports, said plurality of blocks providing base or ground support for said deck support members, said decking surface material being fastened to said horizontal decking surface support members, said configured arrangement including said horizontal decking surface support members in parallel rows directly supporting said decking surface material, some of said horizontal decking surface support members being directly supported by said vertical pillar supports, some of said said horizontal decking surface support being directly supported by said plurality of blocks each block of said plurality of blocks directly engaging a deck support member of said configured arrangement of said support members for support of said deck construction on uneven ground, each block of said plurality of blocks being of the same construction, each block of said plurality of blocks having a top and bottom surface with a recess molded in said top surface, said recess extending fully across the top surface of said blocks, said recess having a central socket portion, each block of said plurality of blocks that directly engages a horizontal decking surface support member having said horizontal decking surface support member extending through said recess and central socket portion fully across each said block therein engaged, said block securing a deck support member in a connector free engagement.

2. The deck construction of claim 1 wherein said horizontal decking surface support members are $2\times6$ lumber and said vertical pillar supports are $4\times4$ lumber.

3. The deck construction of claim 1 wherein each and every block of said plurality of blocks is identical.

* * * * *

UNITED STATES PATENT AND TRADEMARK OFFICE

CERTIFICATE OF CORRECTION

PATENT NO. : 5,163,967

DATED : November 17, 1992

INVENTOR(S) : Paul Hoffman and Sam H. Bright

It is certified that error appears in the above-identified patent and that said Letters Patent is hereby corrected as shown below:

Column 5, line 4, delete "having"

Column 5, line 14, delete "unleveled on" and insert -- on unleveled --

Column 5, line 34, after "deck" insert -- since these blocks range in --

Column 6, Claim 1, line 27, delete "said" (second occurrence)

Column 6, Claim 1, line 28, after "support" insert -- members --

Signed and Sealed this

Twenty-third Day of November, 1993

*Attest:*

*Attesting Officer*

Bruce Lehman

BRUCE LEHMAN

*Commissioner of Patents and Trademarks*